United States Patent [19]

Wolstencroft

[11] 4,135,356

[45] Jan. 23, 1979

[54] FRICTION FALSE TWISTER

[75] Inventor: Michael J. Wolstencroft, Kingston, Canada

[73] Assignee: Du Pont of Canada Limited, Montreal, Canada

[21] Appl. No.: 878,002

[22] Filed: Feb. 15, 1978

[30] Foreign Application Priority Data

Jul. 18, 1977 [CA] Canada ..... 282966

[51] Int. Cl.[2] ..... D01H 7/92; D02G 1/02

[52] U.S. Cl. ..... 57/343; 57/100

[58] Field of Search ..... 57/77.3, 77.4, 77.45, 57/34 R

[56] References Cited

U.S. PATENT DOCUMENTS

| | | | |
|---|---|---|---|
| 3,066,473 | 12/1962 | Maeda | 57/77.4 |
| 3,537,250 | 11/1970 | MacKintosh | 57/77.4 |
| 3,656,290 | 4/1972 | Krussaari | 57/77.4 |
| 3,948,034 | 4/1976 | Gosden | 57/77.4 X |

FOREIGN PATENT DOCUMENTS

| | | | |
|---|---|---|---|
| 947587 | 5/1979 | Canada. | |
| 467816 | 5/1966 | Japan | 57/77.4 |
| 2207780 | 2/1972 | Fed. Rep. of Germany | 57/77.4 |

*Primary Examiner*—Donald Watkins

[57] ABSTRACT

An improved rotatable twist tube device is disclosed for false twist texturing a continuous filament thermoplastic yarn being passed through the twist tube. The twist tube comprises a hollow shaft rotor constituted as the rotor of an electric motor. Two bell housings, one attached to each end of the motor body, house ball bearings which support the hollow shaft rotor near each of its ends. A friction bushing is positioned in each end of the hollow shaft rotor. The friction bushings each have a rounded front friction surface and have a back surface extending outwards from the hollow shaft rotor. The improvement comprises an annular extension of each bell housing which projects beyond the end of the hollow shaft rotor and encompass a portion of the adjacent bushing. The annular extension of each bell housing is adapted to prevent yarn wraps on the outside of the hollow shaft rotor by deflecting such wraps onto the surface of the friction bushing.

6 Claims, 5 Drawing Figures

FRICTION FALSE TWISTER

BACKGROUND OF THE INVENTION

This invention relates to a rotatable twist tube device for false twist texturing a continous filament thermoplastic yarn being passed through the twist tube, in which the twist tube constitutes the hollow shaft rotor of an electric motor.

Rotatable twist tube devices in which the twist tube constitutes the rotor of an electric motor are known in the art, for example in U.S. Pat. No. 3,656,290 of P. Kuussaari, which issued on Apr. 18, 1972, and in Canadian Pat. No. 947,587, which issued May 21, 1974 on an invention by E. L. Creelman et al. In such an existing rotatable twist tube device, friction bushings, each having rounded front friction surface, are positioned in the opposite ends of the hollow shaft rotor which comprises the twist tube. The hollow shaft rotor is mounted near each of its ends in a bearing means supported by the end housing of the motor. A continuous filament thermoplastic yarn passed through the hollow shaft rotor has a rolling twist imparted to it by the rounded surface of each of the two friction bushings as the hollow shaft rotor of the electric motor rotates at high speed.

A disadvantage of such an existing rotatable twist tube device becomes apparent when a break in the yarn occurs at either end of the hollow shaft rotor. The friction bushing at the end near the break may act as a winder and wrap the loose tail of yarn around the outside of the hollow shaft rotor behind the bushing. As turns of yarn build up, the yarn is jammed into the annular space between the end housing of the motor and the rotating hollow shaft rotor. Continued rotation of the hollow shaft rotor compacts the jammed turns of yarn into a tight wad of fiber which may cause one or more of the following to occur: (1) the motor to be stopped; (2) the stator winding of the motor to be overloaded causing overheating and frequently failure of the stator winding; and (3) in some instances, if the hollow shaft rotor continues to rotate, the wad of fiber works its way past the bearing seal and destroys the motor bearings. Once the wad of fiber has formed and jammed the motor, it is not possible for the operator on duty in the false twist texturing area to remove the wad of fiber and restring the texturing position. The motor has to be replaced by another unit and the jammed motor disassembled, cleaned and, if necessary, repaired.

SUMMARY OF THE INVENTION

It is an object of the present invention to provide a rotatable twist tube constituting the hollow shaft rotor of an electric motor, in which yarn wraps, which may build up at one of the friction bushings in the ends of the hollow shaft rotor when a break occurs in the yarn being textured, may be removed and the texturing position restrung by the operator of the texturing area.

With this and other objects in view, the present invention provides in a rotatable twist tube device for false twist texturing a continuous filament thermoplastic yarn being passed through the twist tube, in which the twist tube comprises a hollow shaft rotor constituted as the rotor of an electric motor having an axis of rotation, a tubular motor body having opposite ends, two bell housings, one attached to each end of the motor body, house ball bearings which support the hollow shaft rotor near each of its ends, a friction bushing positioned in each end of the hollow shaft rotor and projecting therefrom adjacent to a bell housing, the friction bushings each having a rounded front friction surface and a back surface extending outwards from the hollow shaft rotor, the improvement comprising an annular extension of each bell housing projecting beyond the end of the hollow shaft rotor and encompassing a portion of the adjacent bushing.

In an embodiment of the present invention, the rotatable twist tube device includes an indentation in the back surface of each friction bushing, the annular extension of each bell housing projecting into the annular indentation in the adjacent bushing.

In another embodiment of the present invention, the annular indentation in each friction bushing is semi-circular in cross section.

In yet another embodiment of the present invention, the annular extension of each bell housing projecting into the annular indentation of the adjacent bushing has an outer surface which slopes into said indentation at an angle of from about 30° to about 60° to the axis of rotation of the motor.

In a further embodiment of the present invention, the annular extension of each bell housing projecting into the annular indentation of the adjacent bushing has an outer surface which slopes into said indentation at an angle of from about 40° to about 50° to the axis of rotation of the motor.

DETAILED DESCRIPTION OF THE PREFERRED EMBODIMENT

Figure 1:
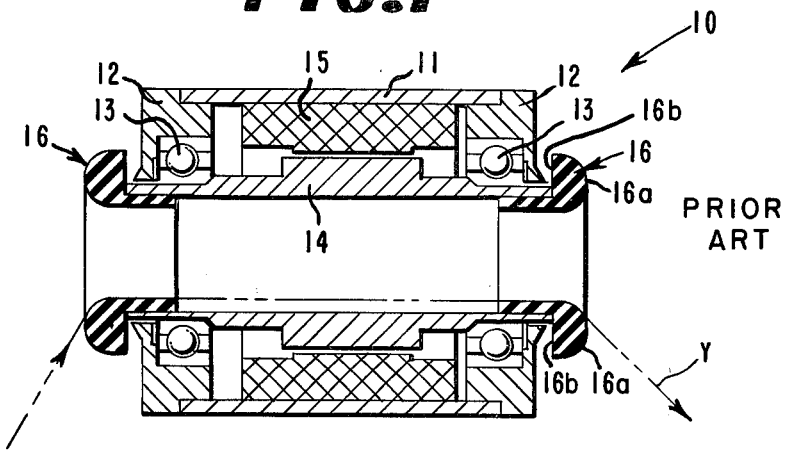
FIG. 1 is a half section view of a rotatable twist tube according to the prior art.
Figure 1A:
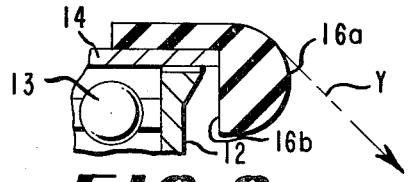
FIG. 1A is an enlargement of a portion of FIG. 1.

In FIGS. 1 and 1A, a rotatable twist tube device according to the prior art is designated generally by the numeral 10. The twist tube device 10 has a tubular motor body 11. Two bell housings 12, one attached to each end of the motor body 11, house ball bearings 13 which support a hollow shaft rotor 14 near each of its ends. A stator winding 15 cooperates with hollow shaft rotor 14 to form a synchronous motor which is capable of speeds up to 33,000 rpm. A friction bushing 16 is positioned in each end of the hollow shaft rotor 14. Each friction bushing 16 has a rounded front friction surface **16*a* and a back surface 16*b* which extends outwards from the hollow shaft rotor 14. The yarn to be textured, by passing it through hollow shaft rotor 14** at speeds of from 200 to 1000 meters per minute, is designated by the letter Y.

In operation the yarn Y has a false twist imparted to it by the rounded surface of the friction bushings 16 as hollow shaft rotor 14 rotates at high speed. When a break occurs in the yarn at either end of the hollow shaft rotor 14, the friction bushing 16 on the end of the hollow shaft rotor 14, nearest the break may act as a winder and wrap the loose tail of yarn around the hollow shaft rotor 14 behind the back surface 16B of bushing 16. As turns of yarn build up, the yarn is jammed into the annular space 17 formed between the adjacent surfaces of bell housing 12 and hollow shaft rotor 14. Continued rotation of the hollow shaft rotor 14 tends to compact the jammed turns of yarn into a tight wad of fiber which may cause one or more of the following to occur: (1) the synchronous motor to be stopped; (2) the stator winding 15 to be overloaded causing overheating and frequently failure of the stator winding 15; (3) in some instances if the hollow shaft rotor 14 continues to rotate, the wad of fiber works its way past the seal of the ball bearings 13 and destroys the ball bearings 13; and (4) in some instances if the ball bearings 13 are destroyed, the outer race of the ball bearings 13 rotates in bell housing 12 and damages the seat of ball bearings 13. Once the wad of fiber has formed and jammed the motor, it is not possible for the operator on duty in the false twist texturing area to remove the wad of fiber and to restring the texturing position. The motor has to be replaced by another unit and the jammed motor disassembled, cleaned and, if necessary, repaired in a maintenance area.

Figure 2:
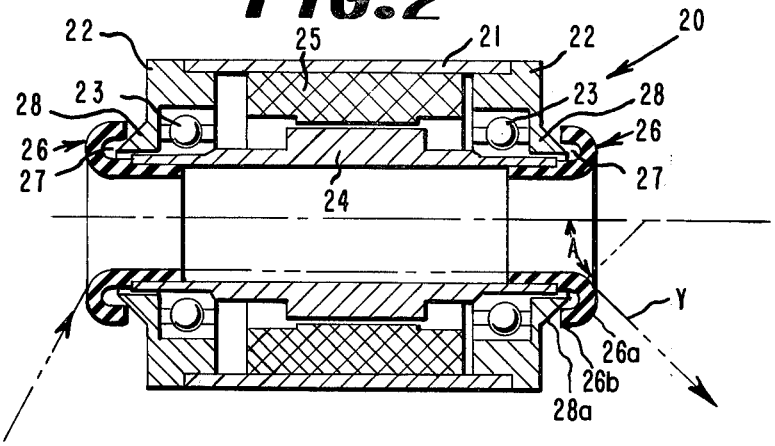
FIG. 2 is a half section view of a rotatable twist tube according to an embodiment of the present invention.
Figure 2A:
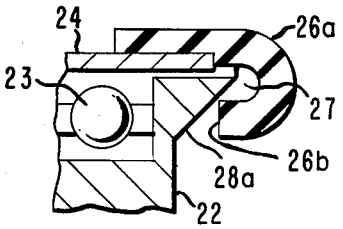
FIG. 2A is an enlargement of a portion of FIG. 2.

In FIGS. 2 and 2A a rotatable twist tube device according to an embodiment of the present invention is designated generally by the numeral 20. The twist tube device has a tubular motor body 21. Two bell housings 22, one attached to each end of the motor body 21, house ball bearings 23 which support a hollow shaft rotor 24. A stator winding 25 cooperates with hollow shaft rotor 24 to form a synchronous motor which is capable of speeds up to 33,000 rpm. A friction bushing 26 is positioned in each end of the hollow shaft rotor 24. Each friction bushing 26 has a rounded front friction surface **26*a* and has a back surface 26*b* which extends outwards from the hollow shaft rotor 24. An annular indentation 27 is provided in the back surface of each friction bushing 26. An outer annular extension 28 of each bell housing 22 projects beyond an end of the hollow shaft rotor 24 into the annular indentation 27 in the adjacent bushing 26. The yarn to be textured, by passing it through hollow shaft rotor 24** at speeds of from 500 to 1000 meters per minute, is designated by the letter Y.

In operation the yarn Y has a false twist imparted to it by the rounded surface of each friction bushing 26 as hollow shaft rotor 24 rotates at high speed. When a break occurs in the yarn at either end of the hollow shaft rotor 24, the friction bushing 26 on the end of the hollow shaft rotor 24, nearest the break may act as a winder and wind up the loose tail of yarn. However, the loose tail of yarn, instead of being wrapped around the hollow shaft rotor 24, is deflected by the outer surface **28*a* of the annular extension 28 of the bell housing 22 into the annular indentation 27 in the adjacent friction bushing 26. As turns of yarn build up in indentation 27, the friction bushing 26 is compressed, usually causing it to become unseated from the end of the hollow shaft rotor 24. The hollow shaft rotor 24 continues to rotate and no damage to the synchronous motor occurs. The operator on duty in the false twist texturing area then shuts down the motor, removes the loosened friction bushing 26 from the end of the hollow shaft rotor 24, removes the turns of yarn from the indentation 27 of friction bushing 26, replaces friction bushing 26 in the end of hollow shaft rotor 24**, restarts the motor and restrings the texturing position.

The shape of the annular indentation 27 in each friction bushing 26 is not critical. For example, the annular indentation 27 may be semicircular in cross section or it may be substantially rectangular in cross section, the inner corners being rounded, if desired, for ease of fabrication.

The shape of the annular extension 28 of each bell housing 22 is not critical, provided that its outer surface **28*a* serves to guide any yarn wraps into indentation 27 of friction bushing 26. Preferably the outer surface of annular extension 28 of each bell housing 22 slopes into indentation 27** at an angle A of from about 30° to about 60° to the axis of rotation of the motor.

Figure 3:
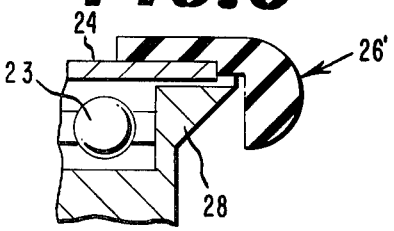
FIG. 3 is a portion of a section view of the invention illustrating an alternate embodiment.

Although the embodiment of the present invention shown in FIG. 2 includes an annular indentation 27 in the back surface of each friction bushing 26, it will be appreciated that this feature is not essential to the present invention. For example, the annular indentation 27 may be omitted provided that the annular extension 28 of each bell housing 22 projects beyond the end of the hollow shaft rotor 24 and encompasses a portion of its adjacent friction bushing 26 (FIG. 3).

The present invention is illustrated by the following example.

EXAMPLE

Over a period of several weeks, 144 false twist texturing positions, each using a rotatable twist tube device according to the embodiment of the present invention illustrated in FIG. 2, were operated continuously texturing 20 denier (22.2 dtex) nylon 6,6 continous filament yarn. Each rotatable twist tube constituted the hollow shaft rotor of a three-phase synchronous motor, which operated at a speed of 24,000 rpm. The details of each twist tube device were as follows:

| | | |
|---|---|---|
| hollow shaft rotor: | | |
| length | = | 2.843 inches (7.22 cm) |
| internal diameter | = | 0.780 inches (1.98 cm) |
| rotational speed | = | 24000 rpm |
| friction bushings: | | |
| internal diameter | = | 0.615 inches (1.56 cm) |
| radius of curvature of rounded front face 26a | = | 0.166 inches (0.422 cm) |
| material of construction | = | elastomeric material |
| shape of indentation in the back surface 26b | = | substantially semi-circular i.e. consisting of 2 quarter arcs of radius 0.062 inches (0.157 cm) separated to give a width of opening of 0.150 inches (0.381 cm) |
| bell housings: | | |
| shape of the annular extension of each bell housing 28 into the annular indentation of the adjacent friction bushing | = | the outer surface 28a of the annular extension sloped into the indentation at an angle A of 45° to the axis of rotation of the motor. |

During the above period of time, none of the rotatable twist tube devices had to be replaced because yarn wraps had stopped the motor.

The following information is given for purposes of comparison:

Over a period of many weeks, 3744 false twist texturing positions, each using a prior art rotatable twist tube device as illustrated in FIG. 1, were operated continuously texturing 20 denier (22.22 dtex) nylon 6,6 continuous filament yarn. Each rotatable twist constituted the hollow shaft rotor of a three-phase synchronous motor which operated at a speed of 24,000 rpm. The details of each twist tube were the same as indicated above in the EXAMPLE, except that: (i) there was no indentation in the back surface of each bushing; and (ii) there was no annular extension of each bell housing projecting beyond the end of the hollow shaft rotor.

During the above period of time, an average of 33 of the rotatable twist tube devices had to be replaced each day and repaired and/or cleaned because yarn wraps on the hollow shaft rotor had damaged and/or stopped the motor. The above number of replacements each day was 0.88% of the total number of positions being operated.

I claim:

1. In a rotatable twist tube device for false twist texturing a continuous filament thermoplastic yarn being passed through the twist tube, in which the twist tube comprises a hollow shaft rotor constituted as the rotor of an electric motor having an axis of rotation, a tubular motor body having opposite ends, two bell housings, one attached to each end of the motor body, house ball bearings which support the hollow shaft rotor near each of its ends, a friction bushing positioned in each end of the hollow shaft rotor and projecting therefrom adjacent to a bell housing, the friction bushings each having a rounded front friction surface and a back surface extending outwards from the hollow shaft rotor, the improvement comprising an annular extension of each bell housing projecting beyond the end of the hollow shaft rotor and encompassing a portion of the adjacent bushing.

2. The rotatable twist tube device of claim 1 including an annular indentation in the back surface of each friction bushing, the annular extension of each bell housing projecting into the annular indentation in the adjacent bushing.

3. The rotatable twist tube device of claim 2 wherein the annular indentation in each friction bushing is semicircular in cross section.

4. The rotatable twist tube device of claim 2 wherein the annular indentation in each friction bushing is substantially rectangular in cross-section.

5. The rotatable twist tube device of claim 2, wherein the annular extension of each bell housing projecting into the annular indentation of the adjacent bushing has an outer surface which slopes into said indentation at an angle of from about 30° to about 60° to the axis of rotation of the motor.

6. The rotatable twist tube device of claim 2, wherein the annular extension of each bell housing projecting into the annular indentation of the adjacent bushing has an outer surface which slopes into said indentation at an angle of from about 40° to about 50° to the axis of rotation of the motor.

* * * * *